US005288015A

United States Patent [19]

Sauerwine

[11] Patent Number: 5,288,015

[45] Date of Patent: Feb. 22, 1994

[54] SINGLE WEB BIFOLD WITH OUTGOING AND RETURN ENVELOPE

[75] Inventor: Dean N. Sauerwine, Zionsville, Pa.

[73] Assignee: Moore Business Forms, Inc., Grand Island, N.Y.

[21] Appl. No.: 947,478

[22] Filed: Sep. 21, 1992

[51] Int. Cl.[5] ..... B65D 27/06

[52] U.S. Cl. ..... 229/305; 229/301; 229/300

[58] Field of Search ..... 229/300, 301, 305

[56] References Cited

U.S. PATENT DOCUMENTS

| | | | |
|---|---|---|---|
| 2,710,716 | 6/1955 | Deutschmeister et al. . | |
| 4,023,727 | 5/1977 | Tess | 229/306 X |
| 4,375,868 | 3/1983 | Slotar et al. | 229/92.3 |
| 4,575,121 | 3/1986 | Conti . | |
| 4,896,823 | 1/1990 | Taylor | 229/92.3 X |
| 4,927,072 | 5/1990 | Jenkins et al. | 229/92.3 |
| 4,944,449 | 7/1990 | Schmidt . | |
| 4,944,450 | 7/1990 | Schmidt | 229/301 |
| 4,981,251 | 1/1991 | Jenkins et al. | 229/92.3 |
| 5,174,494 | 12/1992 | Ashby | 229/301 X |

*Primary Examiner*—Allan N. Shoap
*Assistant Examiner*—Jes. F. Pascua
*Attorney, Agent, or Firm*—Nixon & Vanderhye

[57] ABSTRACT

A mailer with a return envelope is formed from an intermediate which is a single ply of paper having first and second faces. Fold lines divide the ply into four about equal size quadrants with outgoing address indicia printed on the first ply first face, and the reply address indicia printed on the third quadrant first face. Adhesive associated with either the second or fourth ply and the third ply forms the second or fourth and the third ply into a return envelope. The return envelope has a closable flap, having adhesive on the second face, which is adjacent the open portion of the return envelope. Permanent adhesive, such as heat seal adhesive, is disposed in border areas on portions of the second faces of at least two of the quadrants, and on the fourth or third quadrant, to hold the ply into a mailer configuration, folded about the fold lines.

20 Claims, 5 Drawing Sheets

MORE INFORMATION/
COUPON
BLOCK-OUT
AREA
PREPRINTED INFORMATION
BLOCK-OUT
AREA
10
12
13
14
15
16
19
20
21
22
23
24
34
35
36
37
38
39
40
41
42
43
44
45
46
47
48
49
55
56
57
59

SINGLE WEB BIFOLD WITH OUTGOING AND RETURN ENVELOPE

BACKGROUND AND SUMMARY OF THE INVENTION

Mailers are widely used types of business forms. It is desirable to be able to manufacture mailers as simply as possible, yet provide a high degree of versatility and functionality thereof. It is, for many circumstances, particularly desirable to be able to form a mailer from a single ply of paper, that has an entirely functional return envelope provided with it, as well as significant areas for printed information, or a return coupon. In the construction of the mailers, it is also desirable to minimize the number of manufacturing steps, prevent sheet length or tenting problems, minimize the use of unrecyclable materials, and to provide flexibility in the construction of a return envelope provided.

According to the present invention, an intermediate for construction of a mailer, and the mailer constructed thereby, are provided which substantially achieves the goals set forth above. According to the present invention, it is possible to make a mailer with a fully functional, and versatile configuration, return envelope, from a single ply of paper, yet provide sufficient space for significant information transmitting indicia, and even to provide a return coupon if desired. The mailer according to the invention is constructed in only two steps, one pass on a press, and one pass on an "85" machine for applying adhesive, and the mailer has a minimum of unrecyclable material, and avoids sheet length and tenting problems.

According to one aspect of the present invention, a mailer intermediate is provided. The intermediate comprises: A single ply having first and second faces. First and second orthogonal fold lines separating the ply into first, second, third and fourth quadrants of substantially the same size, the first and third quadrants diagonally disposed with respect to each other, the first and second quadrants separated by the second fold line, and the first and fourth quadrants separated by the first fold line, each quadrant having first through fourth border lines. The first face of the first quadrant having outgoing address indicia thereon, and the first face of the third quadrant having reply address indicia thereon. First adhesive adjacent the first through third border lines of the second face of the third quadrant and/or the second or fourth quadrants, for forming a return envelope with the third quadrant and one of the second and fourth quadrants, no adhesive disposed along the fourth border line. First perforation means defining a return envelope flap in one of the quadrants in or adjacent the fourth border line which has no adhesive. Information transmitting indicia printed on the second face of whichever of the second and fourth quadrants does not form the return envelope with the third quadrant. Second adhesive disposed on the second face of the return envelope flap. And third adhesive for holding the quadrants together if folded about the first and second fold lines into a mailer, with the first face of the first quadrant and the first face of one of the second or fourth quadrants forming the exterior of the mailer.

Typically, the return envelope is formed from the second and third quadrants, with the first adhesive (typically heat sealable permanent adhesive) disposed on the second ply, and the flap typically formed from the third or fourth plies by the first perforation means. The second adhesive can be rewettable adhesive, and the third adhesive is typically disposed in border areas defined by perforation lines adjacent the border lines of the quadrants, and separable when the mailer is received by a recipient by tearing along perforation lines. Other perforations can be provided which define a coupon portion from the fourth quadrant, which may be readily inserted into the return envelope.

The invention also comprises a mailer formed from the intermediate described above. The mailer comprises: A single ply having first and second faces. First and second orthogonal fold lines separating the ply into first, second, third and fourth quadrants of substantially the same size, the first and third quadrants diagonally disposed with respect to each other, the first and second quadrants separated by the second fold line, and the first and fourth quadrants separated by the first fold line, each quadrant having first through fourth border lines. The first face of the first quadrant having outgoing address indicia thereon, and the first face of the third quadrant having reply address indicia thereon. First adhesive adjacent the first through third border lines of the second face of the third quadrant and/or the second or fourth quadrants, for forming a return envelope with the third quadrant and one of the second and fourth quadrants, no adhesive disposed along the fourth border line. First perforation means defining a return envelope flap in one of the quadrants in or adjacent the fourth border line which has no adhesive. Information transmitting indicia printed on the second face of whichever of the second and fourth quadrants does not form the return envelope with the third quadrant. Second adhesive disposed on the second face of the return envelope flap. The quadrants folded about the first and second fold lines, so that the first face of the first quadrant, and the first face of whichever of the second and fourth quadrants that forms the return envelope with the third quadrant, are visible from the exterior of the mailer while the first face of the third quadrant is not visible. And, third adhesive for holding the quadrants together folded about the first and second fold line.

The mailer described above is typically formed by first folding the intermediate about the first fold line so that the first faces of the quadrants are outward, then folding about the second fold line so that the first faces of the first and second quadrants are facing outward, with fourth adhesive disposed on the first face of the fourth quadrant, and border areas, to facilitate folding the mailer in a compact configuration for mailing. By simply detaching the mailer portions along perf lines, the mailer may be "opened", and the return envelope prepared for reply mailing.

It is a primary object of the present invention to provide an advantageous intermediate for a business form mailer, and mailer constructed thereby, which utilizes a return envelope. This and other objects of the invention will become clear from an inspection of the detailed description of the invention, and from the appended claims.

DETAILED DESCRIPTION OF THE DRAWINGS

Figure 1:
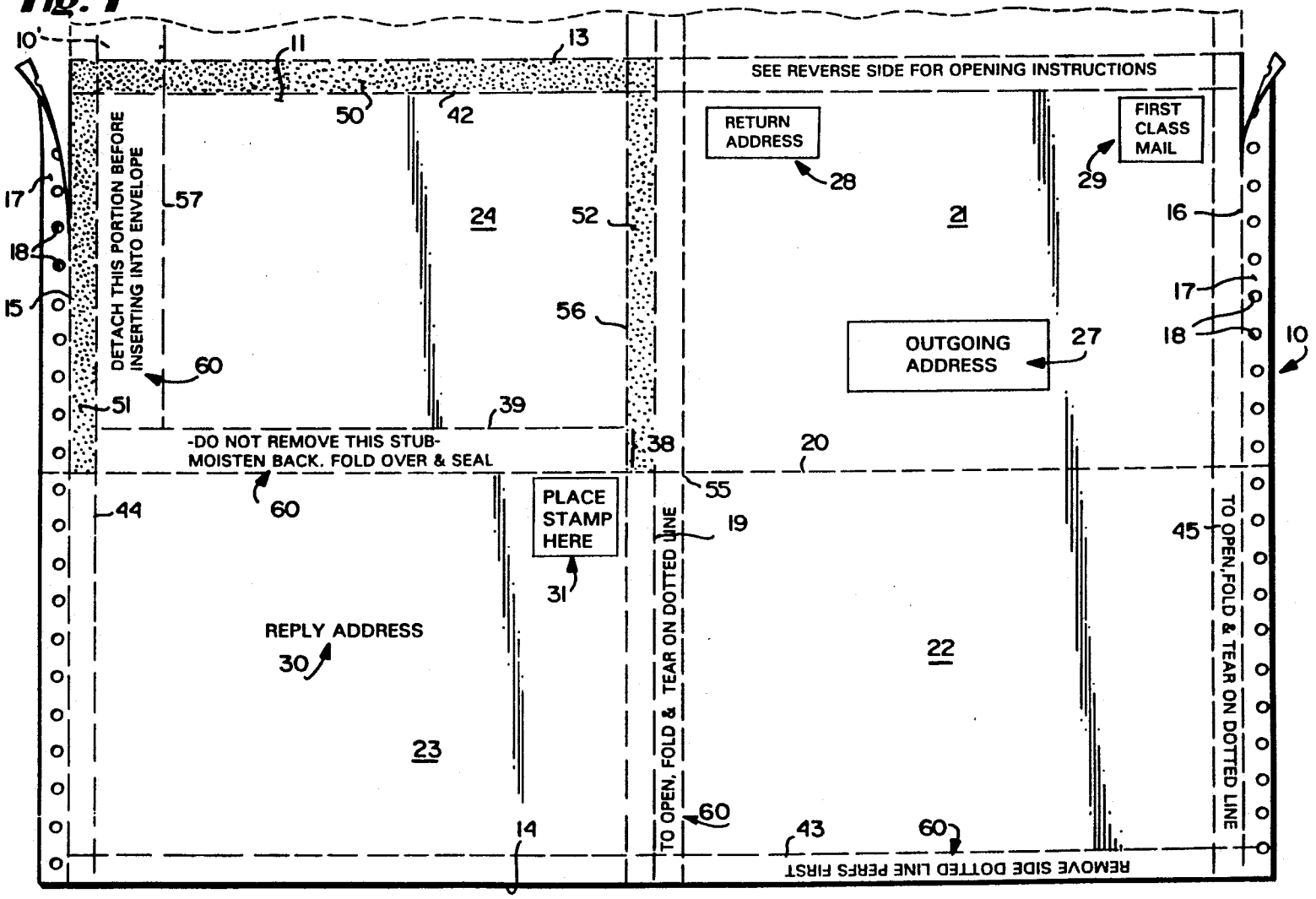
FIG. 1 is a top plan view of the first face of a mailer intermediate according to the invention.
Figure 2:
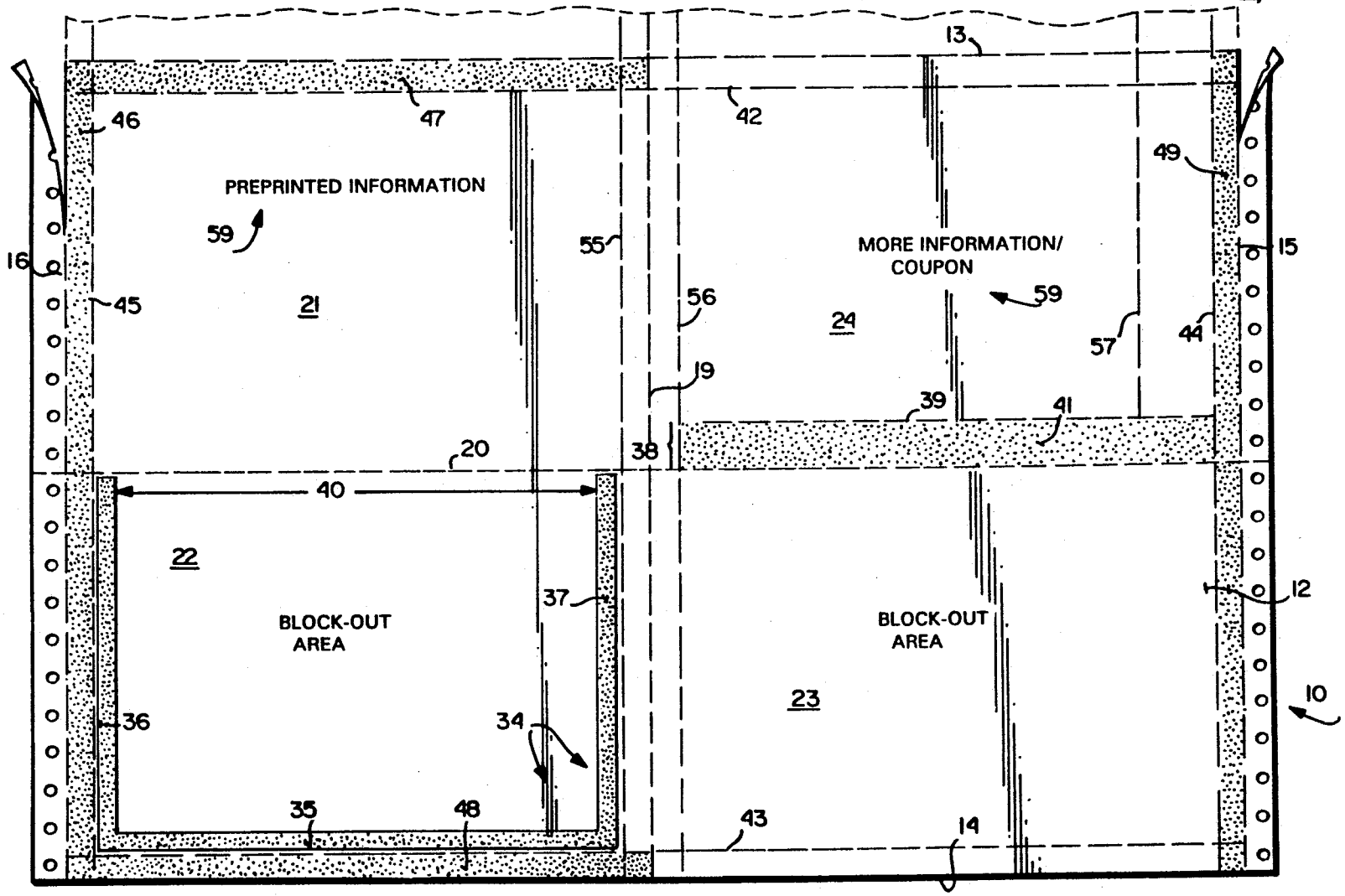
FIG. 2 is a top plan view of the second face of the intermediate FIG. 1.

An exemplary intermediate according to the present invention is shown generally by reference numeral 10 in FIGS. 1 and 2. Preferably, the intermediate is originally in continuous form, as shown by the intermediate 10' illustrated in FIG. 1. The mailer intermediate 10 is formed from a single ply of paper having a first face 11 (FIG. 1), and a second face 12 (FIG. 2). It also has a "top" edge 13, "bottom" edge 14, and side edges 15, 16. Originally during initial construction, detachable edge strips 17 are provided along the side edges 15, 16 having tractor drive holes 18 therein. However, these edge portions 17 are slit off prior to construction of the mailer from the intermediate 10. Note that the edges 13, 14 typically are formed by perforation lines, where the intermediate 10 is part of a continuous web (again see 10' in FIG. 1).

The intermediate 10 also comprises first and second orthogonal fold lines 19, 20, line 19 being parallel to the edges 15, 16 and line 20 to the edges 13, 14. The fold lines 19, 20 may be creases, or perforations. They define the intermediate 10 single paper ply into four substantially equal size and shape quadrants 21, 22, 23, 24. Note, as illustrated clearly in both FIGS. 1 and 2, the first and third quadrants 21, 23 are diagonally disposed with respect to each other, while the first and second quadrants 21, 22 are separated by the second fold line 20, and the first and fourth quadrants 21, 24 are separated by the second fold line 19. Each of the quadrants 21 through 24 has border lines, for example, formed by the edges 13 though 16, or the fold lines 19, 20.

Figure 3:
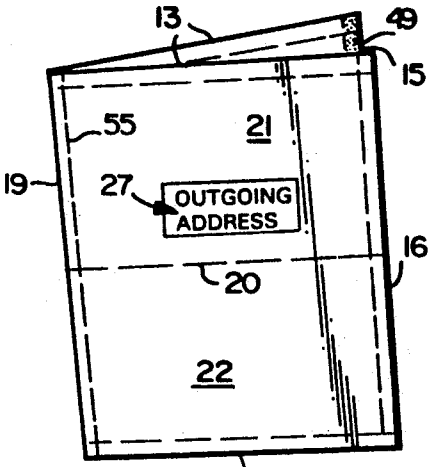
FIG. 3 illustrates the intermediate of FIGS. 1 and 2 folded about the first fold line thereof in the construction of a mailer.

The first face 11 of the first quadrant 21 has outgoing address indicia 27 (see FIGS. 1 and 3) printed thereon, as well as, typically, a return address 28, and either postage 29, or other indicia indicating that postage should be applied. Reply address indicia for a return envelope (to be hereinafter described) is printed on the first face 11 of the third quadrant 23, as indicated by reference numeral 30 in FIGS. 1 and 6. Other indicia 31 indicating that postage is to be applied to the face of another quadrant 23 may also be provided.

Figure 5:
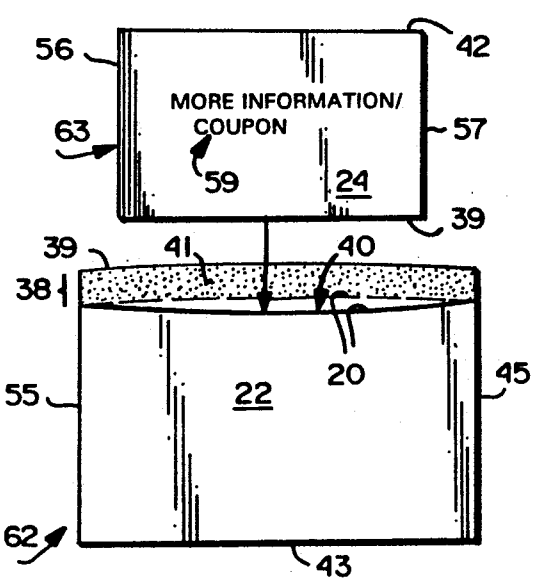
FIG. 5 shows a return envelope of the mailer of FIGS. 1 through 4 from the rear, with a coupon that may be inserted therein.
Figure 6:
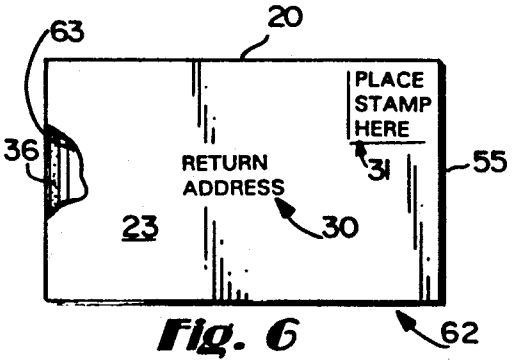
FIG. 6 is a front view of the return envelope of FIG. 5, when sealed, with a portion cut away for clarity of illustration.

The third quadrant 23 cooperates with either the second quadrant 22, or the fourth quadrant 24, to form a return envelope (the return envelope is illustrated at 62 in FIGS. 5 and 6). In FIGS. 1 and 2 a return envelope will be described as formed from the second and third quadrants 22, 23, but it is understood that the fourth quadrant 24 may cooperate with the third quadrant 23 instead.

In order to construct the return envelope, first adhesive, shown generally by reference numeral 34 in FIG. 2, is provided. The first adhesive 34 typically comprises patterns of adhesive, such as the strips 35, 36, and 37 illustrated in FIG. 2, adjacent (though typically spaced from) three of the four border lines of one of the quadrants constructing the return envelope. For the exemplary embodiment illustrated in FIGS. 1 through 6, the first adhesive 34 is shown disposed on the second quadrant 22, but it could alternatively, or in addition, be provided on the third quadrant 23 (or the fourth quadrant 24 if that cooperates with the third quadrant 23 to form the return envelope). The adhesive patterns 35 through 37 typically are strips of heat seal adhesive, although they can comprise other permanent adhesive, such as pressure activated adhesive (e.g. cohesive).

According to the present invention, a return envelope flap 38 (see FIGS. 1, 2 and 5) is formed in one of the quadrants 22 through 24 as by first perforation means 39. Flap 38 is disposed so that it is at the border line 40 of the quadrant with which the first adhesive 34 is associated. As seen in FIG. 2, there is no part of the first adhesive 34 that is provided at the border line 40, so that an opening for the return envelope is provided. The flap 38 has, disposed on the second face 12 of the intermediate 10, second adhesive 41, which may comprise rewettable adhesive, or pressure sensitive adhesive covered by a release strip. Rewettable adhesive is illustrated at 41 in FIG. 2. In the embodiment illustrated in FIG. 2, flap 34 is formed from the fourth quadrant 24, although depending upon the dimensions of the adhesive strips 36, 37, or other factors, it could be formed elsewhere. For the embodiment of FIGS. 1 through 6, the second fold line 20 serves as the fold line for the flap 38.

A number of other perforation lines are also provided to allow easy opening of the final mailer form from the intermediate 10, after third adhesive (to be hereinafter described) is utilized to hold the quadrants together. Such other perforation means, in the form of second perforation line 42, third perforation line 43, fourth perforation line 44, and fifth perforation line 45 (see FIGS. 1 and 2 in particular) are formed parallel to the edges 13 through 16, and spaced only a small distance therefrom to define border areas, which are easily separated from the rest of the quadrants 21 through 24. The third adhesive for holding the quadrants together when folded about the fold lines 19, 20 may take the form of the adhesive patterns (strips) 46 through 48 illustrated in FIG. 2. These strips 46 through 48 are disposed in the border areas in the second face 12 of the intermediate 10, along those portions of the edges 13, 14, and 16 adjacent the first and second quadrants 21, 22. The cooperating adhesive strip 49, adjacent the edge 15 and that portion thereof associated with the third and fourth quadrants 23, 24, also is provided in a border area of the second face 12. The strips 46, 49 cooperate with each other when the intermediate 10 is folded into a mailer, while the strips 47, 48 cooperate with each other. The adhesive forming the strips 46 through 49 may be any suitable permanent adhesive, such as heat seal adhesive, or pressure activated adhesive.

There also is preferably fourth adhesive for holding the quadrants together into a mailer, according to the invention. The fourth adhesive is in the form of the strips 50, 51, and 52 formed on the first face of the quadrant 24 in border areas, as illustrated in FIG. 1. The adhesive of the strips 50 through 52 is also permanent adhesive, and preferably of the same type as the strips 45 through 49 and 35 through 37 so that all the permanent adhesive can be sealed in a single pass through a sealer.

The intermediate 10 also includes sixth and seventh perforation lines 55, 56 (FIGS. 1 and 2) adjacent the fold line 19. Other perforations, such as the eighth perforation means 57 may be provided for defining a coupon from the fourth quadrant 24.

The intermediate 10 also comprises additional indicia for transmitting information to the recipient of the mailer. For example, as illustrated in FIG. 2, information transmitting indicia 59 is printed on the second face 12 of the quadrants 21, 24. Part of that information may be coupon information. Also, as illustrated in FIG. 1, instruction indicia 60 may be printed at various points on the first face 11 to tell the recipient of the mailer formed from the intermediate 10 how to open and utilize the mailer.

In typical manufacture of the intermediate 10, and a mailer from the intermediate 10, a single ply of paper (in continuous form) is passed through a press where all the indicia 27 through 31, 59, and 60 is printed, and through another machine where the fold and perforation lines and glue strips 35 through 37, 41, 45 through 49 and 50 through 52 are applied. Then the intermediates 10 are burst from the continuous form of the web, and are folded first about first fold line 19 (see FIG. 3) and then about second fold line 14 (see FIG. 4) to produce a mailer 61. The mailer 61 is then run (in the configuration of FIG. 4, only completely flat) through a sealing machine, such as a heat sealer which seals all of the glue strips 35 through 37, 45 through 49, and 50 through 52 at the same time, forming the return envelope 62 illustrated in FIGS. 5 and 6, and the final mailer.

When the mailer 61 is received by a recipient, he or she tears along the perforation lines 42–45, 55 and 56 to remove the border portions of the mailer, and to access the information 59. The recipient further detaches the stub 38 from the quadrant 24 along perforation line 39, and the quadrants 21 and 22 from each other along the fold line/perforation line 20, to form the return envelope 62, and also tears along eighth perforation line 57 to form border line 40 of the return envelope 62 and coupon 63. The coupon 63 is inserted into and nests within the return envelope 62 without folding. The flap 38 is then folded about fold line 20 on the first face 11 of the second quadrant 22. Of course, the reply address 30 is readily visible on the first face 11 of the quadrant 23 in the final, sealed return envelope 62 (see FIG. 6), which is mailed to the reply addressee.

Figure 9:
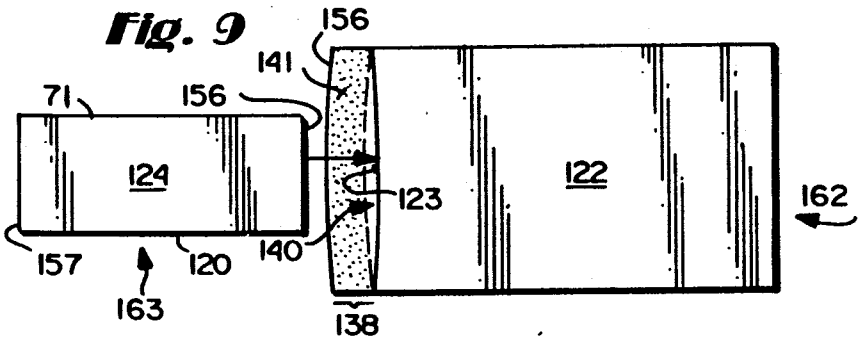
FIG. 9 is a view like that of FIG. 5 for the return envelope associated with the mailer produced from the intermediate of FIGS. 7 and 8.
Figure 4:
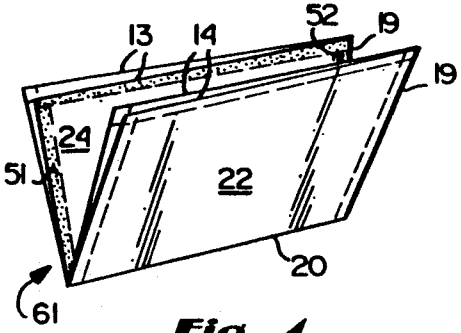
FIG. 4 illustrates the intermediate of FIGS. 1 through 3 being folded about the second fold line thereof to produce a mailer.
Figure 7:
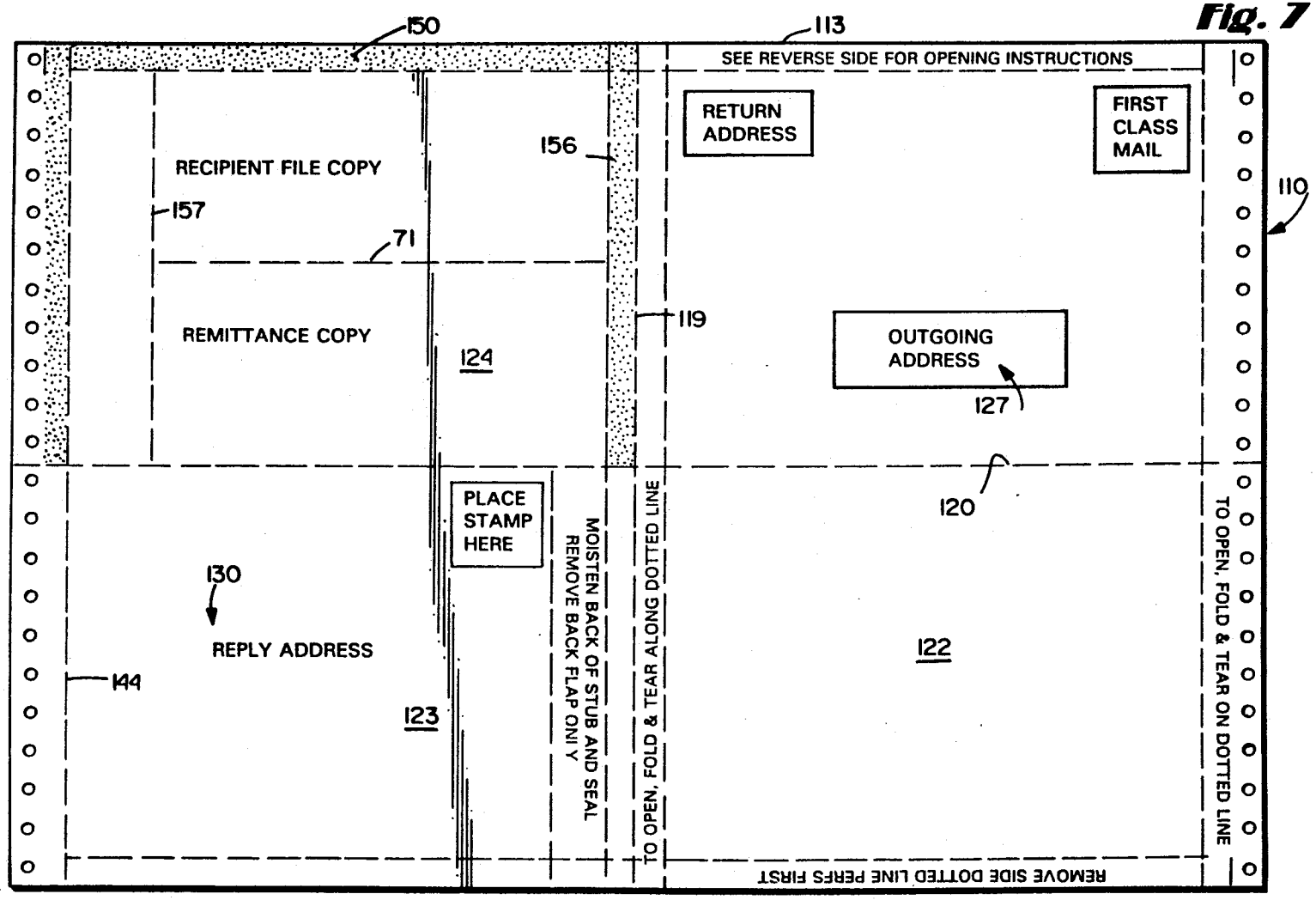
FIGS. 7 and 8 are views like those of FIGS. 1 and 2 for a second embodiment of a mailer intermediate according to the invention.
Figure 8:
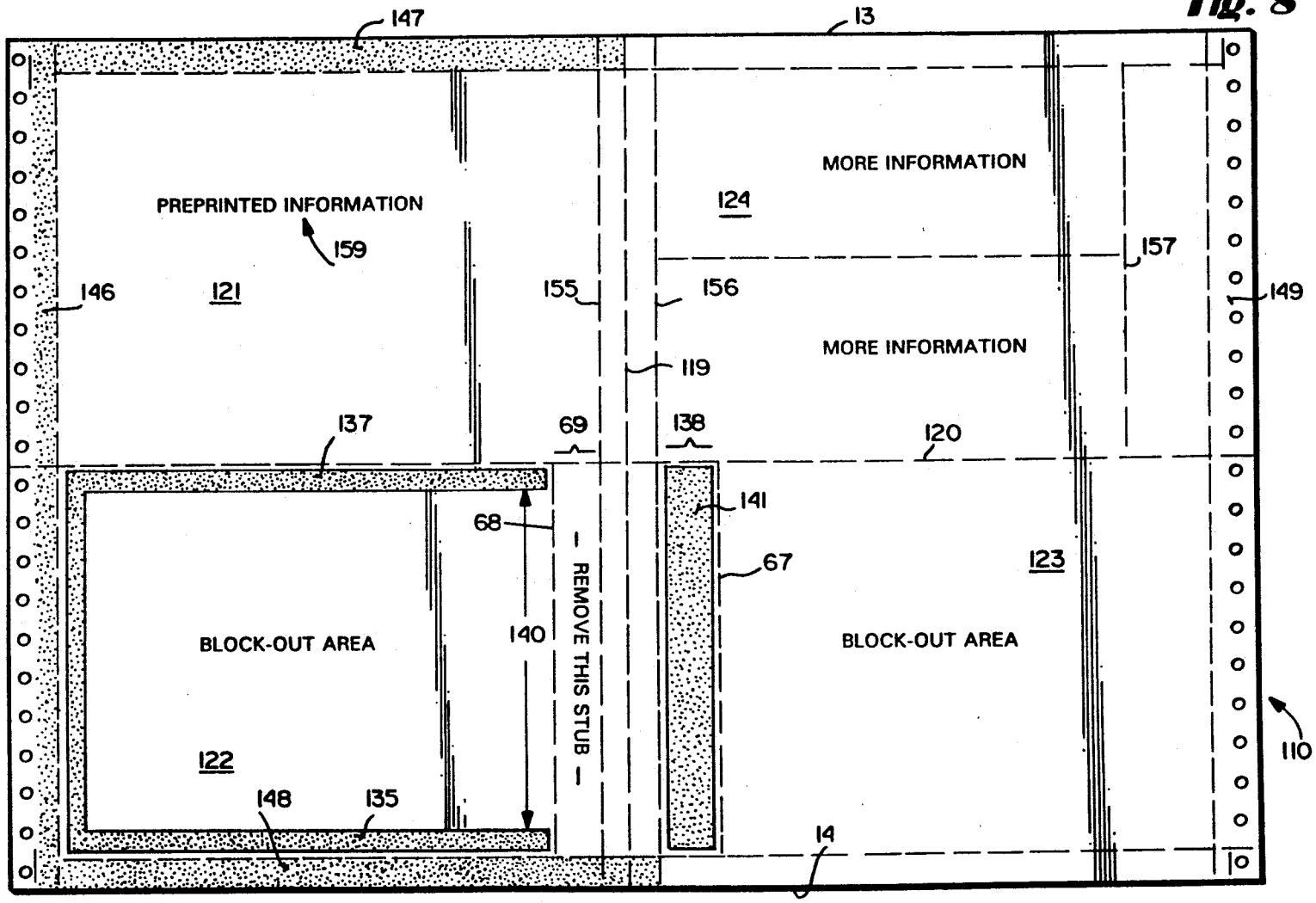

The embodiment illustrated in FIGS. 7 through 9 is very similar to the embodiment of FIGS. 1 through 6, differing primarily in the location of the adhesive strips forming the reply envelope, and the position of the flap to accommodate the side opening of the reply envelope instead of the top opening configuration of FIGS. 5 and 6. In FIGS. 7 through 9 comparable structures are illustrated by the same reference numerals only preceded by a "1".

Focussing on only the differences between the embodiment of FIGS. 7 through 9 and the first embodiment, it will be seen that the adhesive strip 137 is disposed adjacent the second fold line 120, so that the non-adhesive border 140 "opens" toward the third quadrant 123 (see FIG. 8). The return envelope flap 138 is then formed from the third quadrant 123. In order to expose the adhesive 141 on the return envelope flap 138 in the embodiment of FIGS. 7 through 9, additional perforation line 68 is provided (in second quadrant 122) to define, with the perforation line 155, etc., a removable stub 69. An additional perforation or fold line 67 is also provided at the base of the connection of the flap 138 to the rest of the third quadrant 123.

Also, for the embodiments of FIGS. 7 through 9, an additional perforation line 71 is provided to define a recipient file copy and a remittance copy of a "coupon", the coupon 163 illustrated in FIG. 9 having dimensions so that it easily fits within the side opening return envelope 162 formed from the mailer intermediate 110 of FIGS. 7 through 9.

It will thus be seen that according to the present invention an intermediate for a mailer, and a mailer type business form, have been provided which are very advantageous. An easy to use return envelope is made from only a single ply (e.g. web of paper). No plastic window, or like unrecyclable material, is necessary in order to construct the mailer so that it has readily visible outgoing address indicia and reply address indicia. Also, the mailer can be constructed in two steps, one pass on a press, and one pass on an "85" machine, all of the permanent adhesive glue strips being sealed by a single pass through a sealing machine (such as a heat sealer). There are no sheet length or tenting problems, and the construction is versatile so that four different styles of return envelope can be constructed, top open with either front or back top seal, and side open, with either front or back side seal.

While the invention has been herein shown and described in what is presently conceived to be the most practical and preferred embodiment, it will be apparent to those of ordinary skill in the art that many modifications may be made thereof within the scope of the invention, which scope is to be accorded the broad interpretation of the appended claims so as to encompass all equivalent structures and devices.

What is claimed is:

1. A mailer intermediate comprising:

a single ply having first and second faces;

first and second orthogonal fold lines separating said ply into first, second, third and fourth quadrants of substantially the same size, said first and third quadrants diagonally disposed with respect to each other, said first and second quadrants separated by said second fold line, and said first and fourth quadrants separated by said first fold line, each quadrant having first through fourth border lines;

said first face of sad first quadrant having outgoing address indicia thereon, and said first face of said third quadrant having reply address indicia thereon;

first adhesive adjacent the first through third border lines of the second face of at least one of said second, third and fourth quadrants, for forming a return envelope with said third quadrant and one of said second and fourth quadrants, no adhesive disposed along said fourth border line;

first perforation means defining a return envelope flap in one of said quadrants in or adjacent said fourth border line which has no adhesive;

information transmitting indicia printed on said second face of whichever of said second and fourth quadrants does not form said return envelope with said third quadrant;

second adhesive disposed on said second face of said return envelope flap;

third adhesive for holding said quadrants together, when folded about said first and second fold lines into a mailer, with said first face of said first quadrant and said first face of one of said second or fourth quadrants forming the exterior of the mailer, comprising permanent adhesive patterns disposed in said border lines on said second faces of at least two of said quadrants; and second, third, fourth, and fifth perforation means disposed adjacent said first through fourth border lines and defining exterior peripheral portions of two edges of each said quadrants.

2. An intermediate as recited in claim 1 wherein said second and third quadrants form the return envelope.

3. An intermediate as recited in claim 2 wherein said first adhesive is disposed on said second quadrant.

4. An intermediate as recited in claim 3 wherein said fourth border line, along which none of said first adhesive is provided, comprises said second fold line.

5. An intermediate as recited in claim 3 wherein said fourth border line, along which none of said first adhesive is provided, comprises said first fold line.

6. An intermediate as recited in claim 4 wherein said first perforation means forms said return envelope flap in said fourth quadrant.

7. An intermediate as recited in claim 5 wherein said first perforation means forms said return envelope flap in said third quadrant.

8. An intermediate as recited in claim 1 wherein said permanent adhesive patterns are disposed on said second face of both said first and second quadrants.

9. An intermediate as recited in claim 8 further comprising fourth adhesive disposed on said first face of said fourth quadrant in border areas, for holding said first face of said fourth quadrant into operative association with said first face of said third quadrant if said quadrants are folded about said first and second fold lines into a mailer.

10. An intermediate as recited in claim 1 further comprising perforation means for forming a coupon in whichever of said second or fourth quadrants does not cooperate with said third quadrant to form said return envelope, said coupon having dimensions so that it readily fits within said return envelope without folding.

11. A mailer type business form, comprising:

a single ply having first and second faces;

first and second orthogonal fold lines separating said ply into first, second, third and fourth quadrants of substantially the same size, said first and third quadrants diagonally disposed with respect to each other, said first and second quadrants separated by said second fold line, and said first and fourth quadrants separated by said first fold line, each quadrant having first through fourth border lines;

said first face of said first quadrant having outgoing address indicia thereon, and said first face of said third quadrant having reply address indicia thereon;

first adhesive adjacent the first through third border lines of the second face of at least one of said second, third and fourth quadrants for forming a return envelope with said third quadrant and one of said second and fourth quadrants, no adhesive disposed along said fourth border line;

first perforation means defining a return envelope flap in one of said quadrant in or adjacent said fourth border line which has no adhesive;

information transmitting indicia printed on said second face of whichever of said second and fourth quadrants does not form said return envelope with said third quadrant;

second adhesive disposed on said second face of said return envelope flap;

said quadrants folded about said first and second fold liens, so that said first face of said first quadrant, and said first face of whichever of said second and fourth quadrants that forms said return envelope with said third quadrant, are visible from the exterior of said mailer while said first face of said third quadrant is not visible;

third adhesive for holding said quadrants together folded about said first and second fold line, comprising permanent adhesive patterns disposed in said border lines on said second faces of at least two of said quadrants; and second, third, fourth, and fifth perforation means disposed adjacent said first through fourth border lines and defining exterior peripheral portions of two edges of each said quadrants.

12. A mailer as recited in claim 11 wherein said permanent adhesive patterns are disposed on said second face of both said first and second quadrants.

13. A mailer as recited in claim 12 further comprising fourth adhesive disposed on said first face of said fourth quadrant in border areas, for holding said first face of said fourth quadrant into operative association with said first face of said third quadrant.

14. A mailer as recited in claim 11 further comprising perforation means for forming a coupon in whichever of said second or fourth quadrants does not cooperate with said third quadrant to form said return envelope, said coupon having dimensions so that it readily fits within said return envelope without folding.

15. A mailer as recited in claim 11 wherein said second and third quadrants form the return envelope.

16. A mailer as recited in claim 11 wherein said first adhesive is disposed on said second quadrant.

17. A mailer as recited in claim 11 wherein said fourth border line, along which none of said first adhesive is provided, comprises said second fold line.

18. A mailer as recited in claim 11 wherein said fourth border line, along which none of said first adhesive is provided, comprises said first fold line.

19. A mailer as recited in claim 17 wherein said first perforation means forms said return envelope flap in said fourth quadrant.

20. A mailer as recited in claim 18 wherein said first perforation means forms said return envelope flap in said third quadrant.

* * * * *